US008066118B1

(12) United States Patent
Van Tassell

(10) Patent No.: US 8,066,118 B1
(45) Date of Patent: Nov. 29, 2011

(54) DEVICE FOR USING NONWOVEN TOWELS IN THE DAIRY INDUSTRY

(76) Inventor: Marty Van Tassell, Paul, ID (US)

( * ) Notice: Subject to any disclaimer, the term of this patent is extended or adjusted under 35 U.S.C. 154(b) by 58 days.

(21) Appl. No.: 11/616,012

(22) Filed: Dec. 25, 2006

(51) Int. Cl.
*B65D 69/00* (2006.01)
*A45F 5/04* (2006.01)

(52) U.S. Cl. ..... 206/233; 206/494; 224/637; 224/932

(58) Field of Classification Search ..... 206/233, 206/494; 221/33–38, 45, 48; 224/637, 655, 224/664, 932
See application file for complete search history.

(56) References Cited

U.S. PATENT DOCUMENTS

| | | | | | |
|---|---|---|---|---|---|
| 2,125,618 | A | | 8/1938 | Nystrand | |
| 2,615,562 | A | | 10/1952 | Rothbardt | |
| 3,033,362 | A | * | 5/1962 | Marcalus | 206/494 |
| 3,267,903 | A | | 8/1966 | Valentine | |
| 3,713,423 | A | | 1/1973 | Sparr, Sr. | |
| 4,138,034 | A | * | 2/1979 | McCarthy | 221/48 |
| 4,681,240 | A | * | 7/1987 | Wyant | 221/48 |
| 4,817,790 | A | * | 4/1989 | Porat et al. | 206/205 |
| 5,101,770 | A | | 4/1992 | Stevenson | |
| 5,172,838 | A | * | 12/1992 | Rowell et al. | 224/680 |
| 5,366,732 | A | | 11/1994 | Zighelboim | |
| 5,462,197 | A | * | 10/1995 | Pound | 221/46 |
| 5,673,650 | A | | 10/1997 | Mottram et al. | |
| D389,682 | S | * | 1/1998 | Gene | D6/518 |
| 5,919,471 | A | | 7/1999 | Saferstein | |
| 6,155,204 | A | | 12/2000 | van der Lely et al. | |
| 6,427,839 | B1 | * | 8/2002 | Helfer-Grand | 206/494 |
| 6,550,420 | B1 | | 4/2003 | Bjork | |
| 6,997,345 | B2 | * | 2/2006 | Mitchell et al. | 221/283 |
| 7,073,462 | B1 | * | 7/2006 | Layman | 119/161 |
| 7,699,214 | B2 | * | 4/2010 | Mestre et al. | 229/232 |
| 2002/0036153 | A1 | * | 3/2002 | Yang | 206/494 |
| 2003/0052034 | A1 | * | 3/2003 | Bredahl | 206/494 |
| 2007/0000629 | A1 | * | 1/2007 | Tirimacco et al. | 162/109 |
| 2008/0060972 | A1 | * | 3/2008 | Rappaport et al. | 206/581 |

FOREIGN PATENT DOCUMENTS

| | | |
|---|---|---|
| CA | 2529238 | 6/2006 |
| WO | 0058201 | 9/2000 |
| WO | 03022965 | 3/2003 |

* cited by examiner

*Primary Examiner* — J. Gregory Pickett
*Assistant Examiner* — Ernesto Grano
(74) *Attorney, Agent, or Firm* — Michael I. Kroll

(57) ABSTRACT

A method and apparatus for use in the dairy industry to affect the time in preparing a dairy cow for milking and the transference of mastitis in dairy cows with the method the present invention provides: retrieving a quantity of the disposable single fold towels/wipes of the present invention before teat cleaning; extracting a towel/wipe from the quantity and having the maximum surface area of the towel/wipe upon extraction available for use without further manipulation; wiping the udder teats until dry and disposing of the used disposable single fold towel of the present invention. The apparatus of the present invention is a Nonwoven Airlaid or Nonwoven DRC (Double Recreped Cellulose) or 2-6 ply Scrim single fold, interfold towel with a basis weight between 40 GSM (grams per square meter) and 80 GSM, consisting of both virgin pulp (longer fibers) and also recycled pulp (broken or shorter fibers), in the dairy industry.

5 Claims, 10 Drawing Sheets

DEVICE FOR USING NONWOVEN TOWELS IN THE DAIRY INDUSTRY

BACKGROUND OF THE INVENTION

1. Field of the Invention

The present invention relates generally to processes and, more specifically, to a method and apparatus for use in the dairy industry to effect the time in preparing a dairy cow for milking and the transference of mastitis in dairy cows.

While all of the causation's of mastitis are not clearly understood, it is well known that the transference of the disease commonly occurs during milking through use of bacterial infected towels or by using the same towel on more than one cow to dry the teats after cleaning. The present invention provides a disposable single use towel for this purpose.

Another aspect of the present invention is the single fold interleaving of a plurality of said towels. There are quarter fold disposable towels available but time is a precious factor in milking dairy cows and when a herd can number several hundred a reduction in milking preparation of ten seconds is a reduction in labor of an hour and a half in a herd of five hundred head. In itself a considerable reason for employing the method of the present invention but a more important aspect of the method of a single fold is that withdrawing a towel/wipe exposes the entire surface area for use as opposed to a quarter fold that may be used as is due to time constraints or incompetence. The present invention provides a towel/wipe of maximum surface area upon extraction without further manipulation that serves the function of ease of use and time required for service placement.

Additionally, the method of the present invention provides a container for a plurality of said towels/wipes that is attachable and detachable to a user performing the task of teat cleaning whereby the container comprises a housing having a dispensing port that optionally provides for closure and access to the container towel/wipe supply for replenishment and user fastening means, well known within the art, such as belt and/or fastener, such as a clip fastener. As an example, a fanny pack would suit this purpose. The present invention also provides a structurally mounted dispenser (e.g. post, fence rail, wall, etc.) having a plurality of said towels/wipes whereby a user can simply grab a hand full of said towels before commencing with the task.

The method of the present invention provides: retrieving a quantity of the disposable single fold towels/wipes of the present invention before teat cleaning; extracting a towel/wipe from the quantity and having the maximum surface area of the towel/wipe upon extraction available for use without further manipulation; wiping the udder teats until dry and disposing of the used disposable single fold towel of the present invention.

The apparatus of the present invention is a Nonwoven Airlaid or Nonwoven DRC (Double Recreped Cellulose) or 2-6 ply Scrim single fold, interfold towel with a basis weight between 40 GSM (grams per square meter) and 80 GSM, consisting of both virgin pulp (longer fibers) and also recycled pulp (broken or shorter fibers), in the dairy industry.

The dairy industry includes but is not limited to any structure or facility that produces milk for either human or animal consumption or facilities that process or pasteurize milk. These facilities include but are not limited to milking parlors, dairy barns, wash rooms, show barns, dairy hospital barns, maternity facilities, bull collection facilities and pasteurizing plants.

The Nonwoven Airlaid or Nonwoven DRC (Double Recreped Cellulose) or 2-6 ply Scrim single fold, interfold towel with a basis weight between 40 GSM (grams per square meter) and 80 GSM, consisting of both virgin pulp (longer fibers) and also recycled pulp (broken or shorter fibers), used in the dairy industry may be packaged loosely or banded in a variety of towel counts. The towels may then be dispensed by several methods including but not limited to fanny packs, wall dispensers, portable dispensers, pop up boxes, or manually without any dispenser.

2. Description of the Prior Art

There are other devices designed for treating cows teats prior to milking. Typical of these is U.S. Pat. No. 2,125,618 issued to Nystrand on Aug. 2, 1938.

Another patent was issued to Valentine on Aug. 23, 1966 as U.S. Pat. No. 3,267,903. Yet another U.S. Pat. No. 3,713,423 was issued to Spam Sr. on Jan. 30, 1973 and still yet another was issued on Apr. 7, 1992 to Stevenson as U.S. Pat. No. 5,101,770.

Another patent was issued to Zighelboim on Nov. 22, 1994 as U.S. Pat. No. 5,366,732. Yet another U.S. Pat. No. 5,673,650 was issued to Mottram, et al. on Oct. 7, 1997. Another was issued to Saferstein, et al. on Jul. 6, 1999 as U.S. Pat. No. 5,919,471 and still yet another was issued on Dec. 5, 2000 to van der Lely, et al. as U.S. Pat. No. 6,155,204.

Another patent was issued to Bjork on Apr. 22, 2003 as U.S. Pat. No. 6,550,420. Yet another International Patent Application No. WO 00/56201 was issued to Keck, et al. on Sep. 28, 2000. Another was issued to Durden on Mar. 20, 2003 as International Patent Application No. WO 03/022965 and still yet another was issued on Dec. 7, 2005 to Radu, et al. as Canada Patent No. CA 2 529 236.

U.S. Pat. No. 2,125,618

Inventor: Daniel Nystrand

Issued: Aug. 2, 1938

A package of interfolded sheets in which the sheets are folded to form a body portion and an interfolded tab, the sheets being arranged with the tab of each sheet overlaying the body portion of the next succeeding sheet of the package and the length of the tab being long enough to assure the projection from the cabinet of the leading edge of the next sheet when the next preceding sheet is withdraw, but not greater than one half of the body of the sheet so that the tabs of successive sheets do not overlaod.

U.S. Pat. No. 3,267,903

Inventor: Clarence R. Valentine

Issued: Aug. 23, 1966

A device for the preparation of a cow' tubular handle section for connection to a water supply, (b) valve control means on said handle for controlling the flow of water through said handle, (c) a nozzle at one end of said handle, (d) brush means surrounding said nozzle, and (e) a strip pad located on said handle adjacent the nozzle and in the path of deflected water flow from said nozzle and brush.

U.S. Pat. No. 3,713,423

Inventor: Anders V. Sparr, Sr.

Issued: Jan. 30, 1973

An udder and teat washing and cleansing apparatus characterized by a teat cup dimensioned to receive and wholly enclose each selected teat. When the cup is positioned the beaded mouth thereof accommodates the teat and encompassing udder with requisite nicety for sanitizing, that is, preparatory to the milking step. The bottom of the cup has valving means including an enclosed nipple which aims the mixed solution on the opening of the teat, where infection (mastitis) usually starts. The solution in the cup is in a state of swish-swashing turbulence and is suitably drained. The cup and valving means includes a trippable lever for one-handed use. The source of supply comprises a simple solution and air containing tank having requisite facilities for regulatable control.

U.S. Pat. No. 5,101,770

Inventor: Dale V. Stevenson

Issued: Apr. 7, 1992

Post-milking and pre-milking udder care to assure udder disinfection, including coloring the udder after milking and decolorizing the udder before milking. The post-milking step includes applying thereto an aqueous solution of an alkali metal hypochlorite and an alkali metal permanganate, whereas the pre-milking step includes applying thereto an aqueous solution of a peroxide and an organic acid. Preferred component compositions include sodium hypochlorite, potassium permanganate, hydrogen peroxide, and acetic acid.

U.S. Pat. No. 5,366,732

Inventor: Jaime Zighelboim

Issued: Nov. 22, 1994

A method of preparing, treating and then milking cows includes the use of a flexible wipe (A) constructed of hydrophilic material containing a moisture-activated antimicrobial composition. The process includes washing teats and udder of a milk-bearing cow with water or an aqueous soap solution; simultaneously drying, sanitizing and conditioning the thus-washed teats and udder with the moisture-activated antimicrobial wipe comprising a hydrophilic substrate impregnated with an antimicrobial agent, effective to sanitize the teats and udder; and then milking the thus-prepared cow.

U.S. Pat. No. 5,673,650

Inventor: Toby Trevor Fury Mottram, et al.

Issued: Oct. 7, 1997

A method of cleaning the teats of a milking animal including providing a cleaning arrangement having a teat receiving aperture, causing or permitting the arrangement to receive a teat and engage the teat locally and causing or permitting relative movement of the teat and cleaning arrangement, releasing from the teat surface unwanted material.

U.S. Pat. No. 5,919,471

Inventor: Lowell Saferstein

Issued: Jul. 6, 1999

A substantially flexible, dry matrix with antimicrobial properties is made from a matrix comprising natural or synthetic, woven, non-woven or knitted fibers, said matrix having been uniformly coated with an amount of a non-aqueous treatment solution sufficient to allow said matrix to retain its substantially dry characteristics. In a preferred embodiment, said non-aqueous treatment solution has between about 70% and 99% of at least one glycol compound, between about 1% and 15% of a PVP-iodine and optionally between about 0 and 15% of a non-ionic surfactant. Also, skin is treated to prevent disease, such as the disinfecting of teats on dairy cows during milking, by wiping the skin with the article.

U.S. Pat. No. 6,155,204

Inventor: Ary van der Lely, et al.

Issued: Dec. 5, 2000

An apparatus for milking animals comprising a milking compartment including a milking robot for automatically connecting and disconnecting teat cups from the animal's teats and for automatically milking the animal. Embodiments of cleaning members for automatically cleaning the teats of the animal before the teat cups are connected thereto are disclosed. The cleaning members include mechanisms applied to the teats of the animal for removing the foremilk therefrom before the milking operation, as such, commences. In lieu of the cleaning members which not only automatically clean the teats of the animal but also remove the foremilk, another group of teat cups are optimally provided for this purpose. The cleaning members comprise two-rotating elements of various cross-sections. Their phases of the rotation or the distance between their axes of rotation or the shape of the elements or a combination thereof can be selectively modified to remove foremilk or to clean the teats.

U.S. Pat. No. 6,550,420

Inventor: Anders Gosta Axel Bjork

Issued: Apr. 22, 2003

The invention relates to a method and an apparatus for minimizing or even avoiding the transfer of an infection from an infected teat/quarter udder to a healthy teat. The invented method for cleaning the teats (9) of a dairy animal's udder is controlled by a robot means (6) for carrying and operating a cleaning means (8, 14) to clean said teats (9) in succession. This is accomplished by first cleaning one or more healthy teat(s), and then cleaning one or more teat(s) being subjected to various levels of infection. The invented apparatus for cleaning the teats of a dairy animal's udder comprises a control unit (1), a cleaning means (8, 14), a robot means (6) controlled by the control unit (1), a robot arm (7) arranged on the robot means (6) to carry and operate the cleaning means (8, 14) so as to clean the dairy animal's teats in succession.

International Patent Application Number WO 00/56201

Inventor: Laura E. Keck, et al.

Published: Sep. 28, 2000

A cleaning system is provided comprising a sealable container housing a saturated stack of durable fine spunbond fiber cleaning sheets; the cleaning sheets have an average fiber diameter less than 18 micrometers, a tensile strength of at least 140-g/g/m<2> and a basis weight between about 15 g/m<2> and 85 g/m<2>. The cleaning sheets can be provided in stacked form and maintained within a sealed container wherein liquid is retained within the individual sheets as well as throughout the stack over time. The sheets can subsequently be removed from the container and applied to a surface wherein a high percent of the liquid is released from the sheet onto the surface in the initial pass and thereby allowing for improved treatment and/or cleaning of the surface.

International Patent Application Number WO 03/022965

Inventor: Catherine Durden

Published: Mar. 20, 2003

Accordingly, the present invention provides a wipe impregnated with a composition having alcohol, preferably ethanol, in a concentration about 60% to about 95% of the total weight of the composition. In addition, the composition has one or more ingredients that mitigate against the unpleasant or unwanted effects of high-concentration alcohol.

Canada Patent Number CA 2 529 236

Inventor: Ion Radu, et al.

Issued: Jun. 7, 2006

The present invention relates to an antimicrobial material comprising sheet of fabric and- metallic salt crystals embedded in an adhesive material covering the sheet of fabric.

While these devices may be suitable for the purposes for which they were designed, they would not be as suitable for the purposes of the present invention, as hereinafter described.

SUMMARY OF THE PRESENT INVENTION

Mastitis is a disease causing inflammation of the mammary gland system in sheep, goats and cows, which affects the composition of their milk and yield. The causative agents are typically bacteria, which can be classified as contagious pathogens and environmental pathogens. The present invention concerns itself more with contagious pathogens than with environmental pathogens which can be greatly affected by the cow's bedding and grazing pasture. Contagious pathogens are passed from cow to cow especially during milking as the following examples typify the problem.

Dairymen have been using paper towels for years to dry cow's teats. The paper towels used were designed for cleaning purposes in areas such as windows or household cleaning jobs. These towels have been designed with the importance of absorption, not strength or softness. Most cows require 2-4 of this type of towel, where 1 of our towels does the job.

Dairymen have also for years used a variety of washable cloth towels. These towels were similarly designed with the emphasis on cleaning ability and also strength with the ability to absorb. The only problem with this towel is, it is virtually impossible to wash this towel and return it to a bacteria free state. Tests have been run by certified labs documenting the bacteria still left in laundered cloth towels, any bacteria level over 100 per square inch is not considered good.

Dairymen have been in need of a quality towel for years. With the average size of today's dairy, the single fold, interfold method is the preferred way.

Cloth Towels and their Problems.

The person generally responsible for washing and drying the towels is one of the milkers (uncontrolled environment). These are usually the same people responsible for making sure the equipment is working properly (adequate hot water, enough chemicals on hand, using the proper chemicals and the proper amount of chemicals, washer and dryer mechanical problems, etc.). There are a lot of variables here that can cause mild to severe consequences if altered or not completed. Since most dairymen don't figure labor into the final costs, we can only assume this is another job given to the milkers that will stretch their day even longer. Most milkers and even some dairymen don't fully understand the problems that can arise if all of these steps are not followed precisely. I don't know how many times I've seen dryers broken for weeks at a time. This is due to miscommunication with the labor or dairymen not realizing the importance of immediate repair.

Some dairymen use a towel cleaning service, which is still an uncontrolled environment but now every other dairyman's mastitis problem is in the same room. There are way too many steps and variables to guarantee quality every time.

In addition to being in the dairy industry all of my life, I ran a small experiment of my own. I visited over 30 dairies in Utah, Colorado, Kansas, Texas, and New Mexico. On this trip I tried to enter the milking parlors unnoticed to observe the milkers. I saw everything from milkers using one towel per cow to milkers using one towel on several cows. The reasons were mostly due to laziness on the milker's part but I actually got one milker to admit that his brother forgot to wash the towels from the morning milking and they were using the few extras while the dirty towels were being laundered. Not only did I see milking procedure problems, but I saw towels not properly laundered due to dryer problems, hot water problems, etc. The point to all of this is that in an uncontrolled environment, anything can happen.

Consequences from the use of unclean towels can be as small as one infected cow to a herd of infected cows. The results are usually somewhere in the middle. Let me share just two experiences I've had in the past few months.

a). A 600 cow dairy had been using cloth towels. The dairy had a mastitis outbreak which immediately placed 30 cows in hospital. This dairyman was familiar with our single service dairy towels because his daughter-in-law used them so he immediately called me. I was able to get him going on our towels that evening. This must not have been his first wreck with the towels he was receiving from a wash service because I'm not aware of any other avenues he even considered. One month later his hospital pen was virtually cleaned out and the problem was solved. I didn't even have to ask if it was the towels because his consulting vet from Twin Falls, Id. was so impressed with the results, that he immediately changed his own dairy to our towels over 2 months ago. I'm sure this vet and his wife did a 1$^{st}$ class job washing their towels because I've know them for over 20 years and they have always done a great job in whatever they do with their dairy. I asked this vet if I could use him as a reference and he said that would be fine.

b. A 300 cow dairy washed their own towels but didn't dry them. This laundering method was a decision made by the manager/30% owner. His somatic cell count was consistently at about 400,000. They started using our towels and within two months had decreased his somatic cell to below 150,000. I think he told me his bonus was $0.30 for being below 150,000. That adds up to over $1800 profit per month for this dairyman in his milk check, not to mention the savings on cull cows and medicine bills. This dairy is owned by two individuals at a 70/30 investment ratio. The larger investor is a vet that has a very successful large and small animal vet business in Jerome Id. He is well known for his excellent service and knowledge he provides to the Jerome Dairymen. If you would like his name he has allowed me to give it to you and he would be happy to tell you how glad he is to have seen me come along and persuade the manager to change his towel procedures.

Through my experience over the last 25 years, I feel any single service dairy wipe is better than washing towels. Some of the single service towels may not clean as well but they eliminate the risks of spreading bacteria.

Our Dairy Wipe is much more absorbent than a cloth towel and has the strength required to do a great job. Our towels are so absorbent dairymen don't need to worry about our towel being used on more than one cow. After one cow, the towel is totally used.

A primary object of the present invention is to provide a nonwoven Airlaid/DRC/Scrim towel within a dispenser that is easily used.

Another object of the present invention is to provide a nonwoven Airlaid/DRC/Scrim towel dispensible from either a wall mounted structure or from a user mountable small waist mounted fabric pouch.

Yet another object of the present invention is to provide a nonwoven Airlaid/DRC/Scrim towel free from bacteria and other mastitis causing pathogens.

Still yet another object of the present invention is to provide a nonwoven Airlaid/DRC/Scrim towel that can be easily dispensed for use within the dairy industry.

Another object of the present invention is to provide a method of use during milking of a cow wherein a cow's teats are cleaned with a wet solution whereupon a single dry nonwoven Airlaid/DRC/Scrim towel is retrieved from said dispenser and used to dry the teats prior to milking.

Yet another object of the present invention is to provide a dry nonwoven Airlaid/DRC/Scrim towel for use in treatment of other farm animals.

Additional objects of the present invention will appear as the description proceeds.

The present invention overcomes the shortcomings of the prior art by providing a method and apparatus for use in the dairy industry to affect the time in preparing a dairy cow for milking and the transference of mastitis in dairy cows with the method the present invention provides: retrieving a quantity of the disposable single fold towels/wipes of the present invention before teat cleaning; extracting a towel/wipe from the quantity and having the maximum surface area of the towel/wipe upon extraction available for use without further manipulation; wiping the udder teats until dry and disposing of the used disposable single fold towel of the present invention. The apparatus of the present invention is a Nonwoven Airlaid or Nonwoven DRC (Double Recreped Cellulose) or 2-6 ply Scrim single fold, interfold towel with a basis weight between 40 GSM (grams per square meter) and 80 GSM, consisting of both virgin pulp (longer fibers) and also recycled pulp (broken or shorter fibers), in the dairy industry.

The foregoing and other objects and advantages will appear from the description to follow. In the description, reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
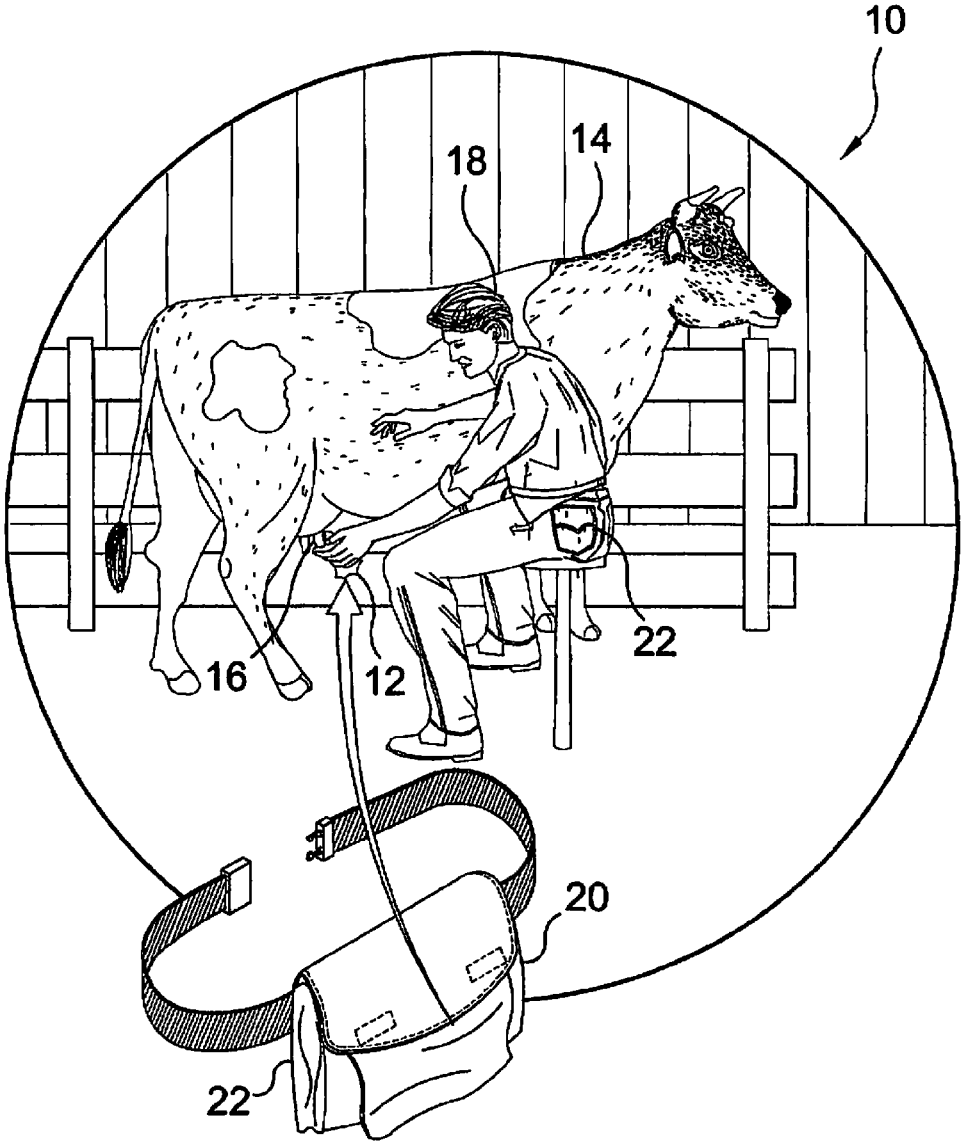
FIG. 1 is an illustrative view of the present invention in use.

Turning now descriptively to the drawings, in which similar reference characters denote similar elements throughout the several views, the figures illustrate the Method and Device for Using Nonwoven Airlaid/DRC/Scrim Towels in the Dairy Industry of the present invention. With regard to the reference numerals used, the following numbering is used throughout the various drawing figures.

10 Method and Device for Using Nonwoven Airlaid/DRC/Scrim Towels in the Dairy Industry
12 towel
14 cow
16 teat
18 user
20 dispenser
22 fanny pack
24 strap of 22
26 dispensing slot
28 cover flap of 22
30 interior cavity of 22
32 body of 22
34 hook and loop fastener element
36 dispensing carton
38 protective seal

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. The present invention 10 is an Airlaid/DRC/Scrim single fold, interfolded towel 12 for use in the dairy industry comprising nonwoven Airlaid/DRC/Scrim towels 12 and efficient method of dispensing said towels 12. The present invention 10 is a great advantage to the agricultural industry by providing a dramatic reduction in infection and transmission of mastitis to dairy herds when the towel 12 is used to clean the teats 16 of a cow 14. Shown is the user 18 wiping down the teats 16 with an Airlaid/DRC/Scrim single fold, interfolded towel 12. A dispensing means 20 is shown here as a fanny pack style dispenser 22 worn by the user 18.

Figure 2:
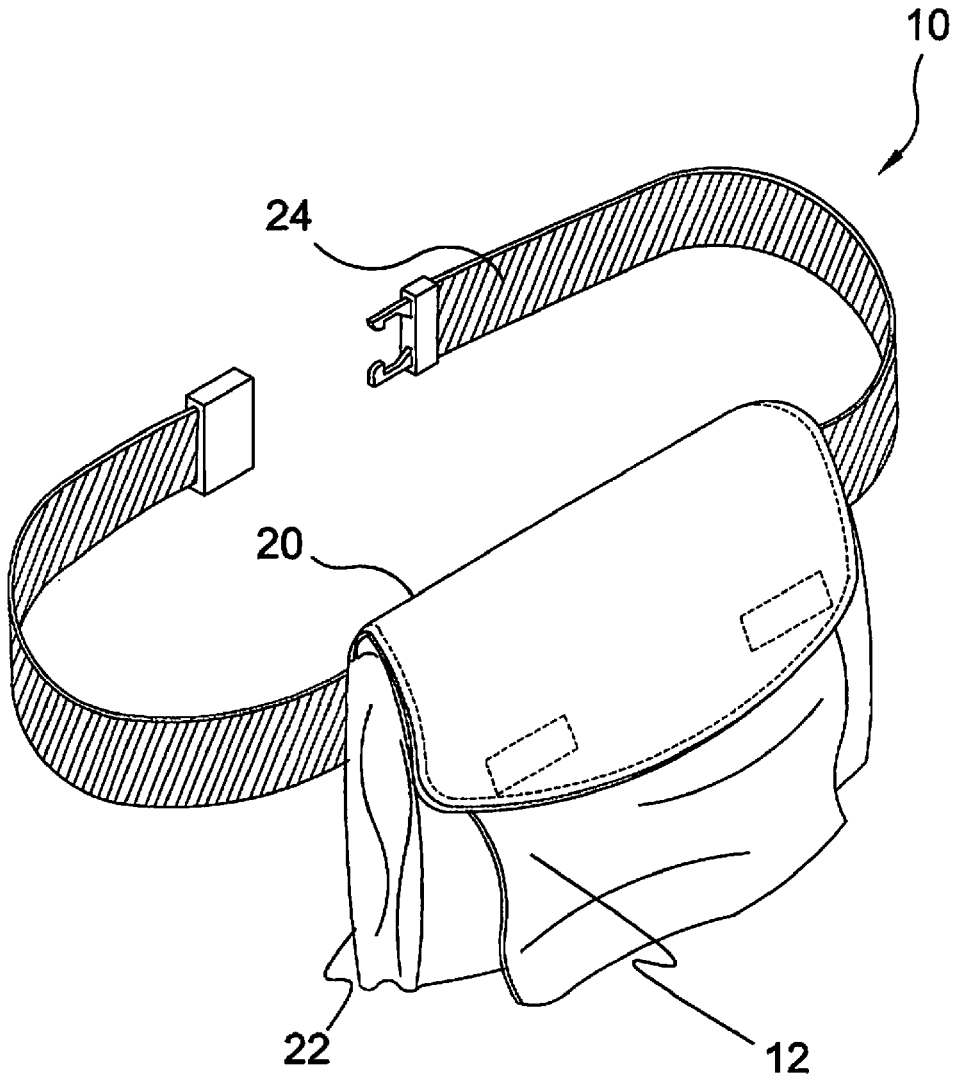
FIG. 2 is a perspective view of one method of dispensing the towel of the present invention.

FIG. 2 is a perspective view of one method of dispensing the towel 12 of the present invention 10. Shown is a dispensing method commonly used by dairy workers to dispense disinfectant towels for the cleaning of cow teats. This method uses a fanny pack 22 with a strap 24 worn by the user as a dispenser 20 to store the towels. The present invention 10 provides the same method but uses the Airlaid/DRC/Scrim single fold, interfolded towels 12 comprising nonwoven towels 12 and stored within its dispenser 20. The present invention 10 is a great advantage to the agricultural industry by providing a dramatic reduction in infection to dairy herds when the towel 12 is used to clean the teats of dairy cows.

Figure 3:
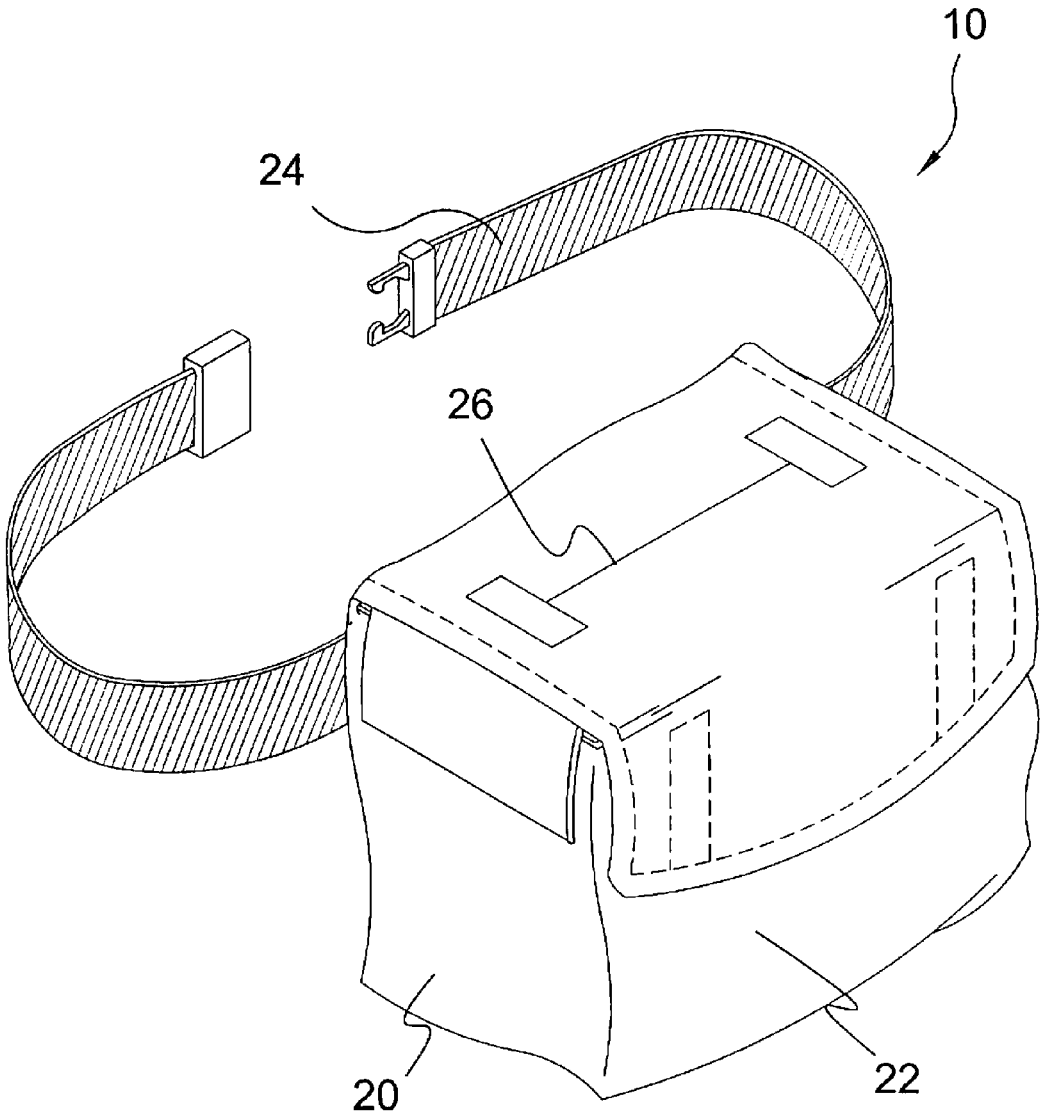
FIG. 3 is a perspective view of one method of dispensing the towel of the present invention.

FIG. 3 is a perspective view of one method of dispensing the towel of the present invention 10. Shown is a dispensing method commonly used by dairy workers to dispense disinfectant towels for the cleaning of cow teats. This method uses a fanny pack 22 with a strap 24 worn by the user as a dispenser 20 to store the towels. The present invention 10 provides the same method but uses the Airlaid/DRC/Scrim single fold, interfolded towels comprising nonwoven towels and stored within its dispenser 20. The present invention 10 is a great advantage to the agricultural industry by providing a dramatic reduction in infection to dairy herds when the towel is used to clean the teats of dairy cows. Additionally shown is a different construction of the fanny pack 22 having a larger capacity and a dispensing slot 26 incorporated therein.

Figure 4:
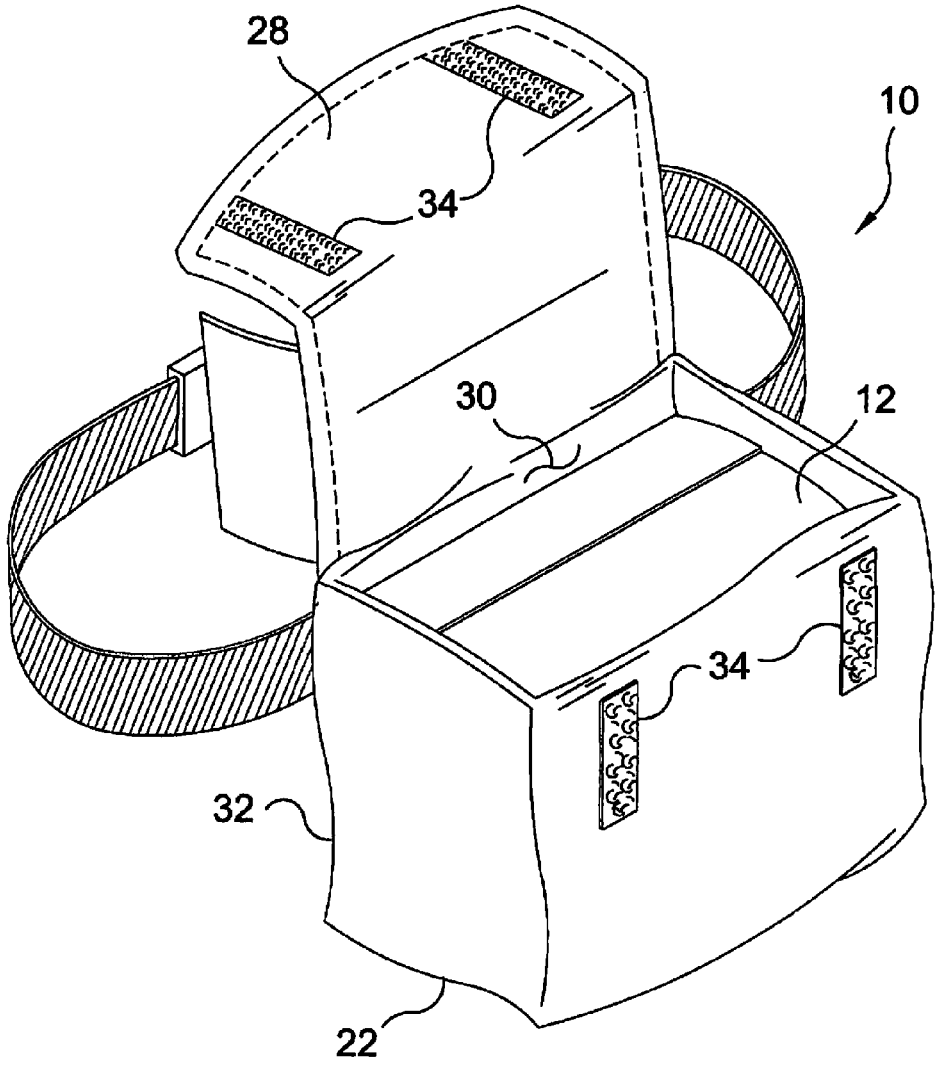
FIG. 4 is a perspective view of one method of dispensing the towel of the present invention.

FIG. 4 is a perspective view of one method of dispensing the towel 12 of the present invention 10. Shown is the fanny pack 22 of the present invention with its cover flap 28 open to reveal how the Airlaid/DRC/Scrim style singlefold towels 12 may be stored therein the provided cavity 30 formed by the body 32 of the fanny pack 22. The cover 28 is secured to the body 32 with hook and loop fastener elements 34.

Figure 5:
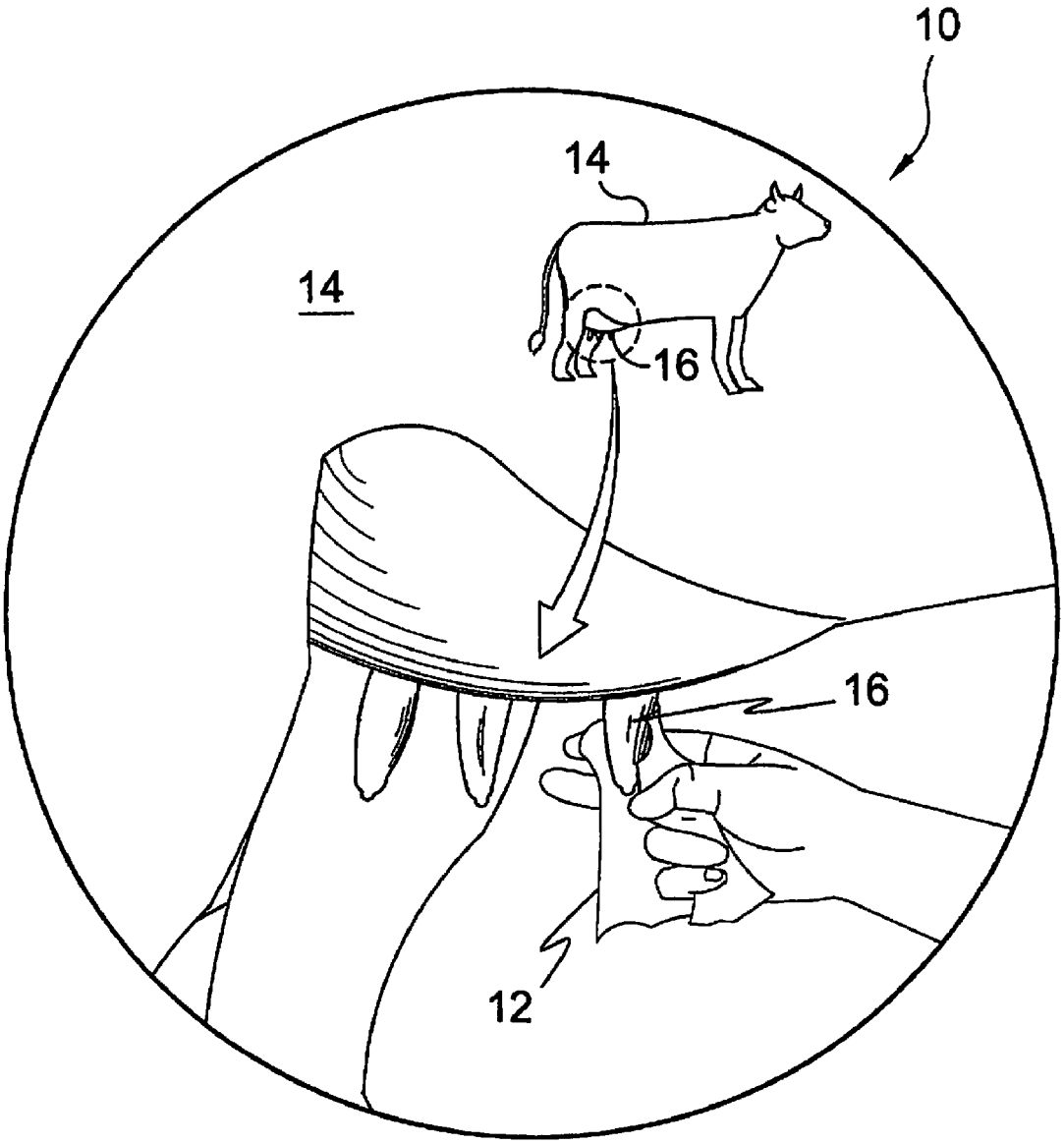
FIG. 5 is an illustrative view of the present invention in use.

FIG. 5 is an illustrative view of the present invention 10 in use. Shown is the present invention 10 in use on the teat 16 of a cow 14. The Airlaid/DRC/Scrim single fold, interfolded towel 12 is used in the dairy industry comprising nonwoven Airlaid/DRC/Scrim towels 12. The present invention provides an efficient method of dispensing said towels 12 for a dramatic reduction in infection to dairy herds due to the spread of mastitius when the towel 12 is used to clean the teats 16 of a cow 14.

Figure 6:
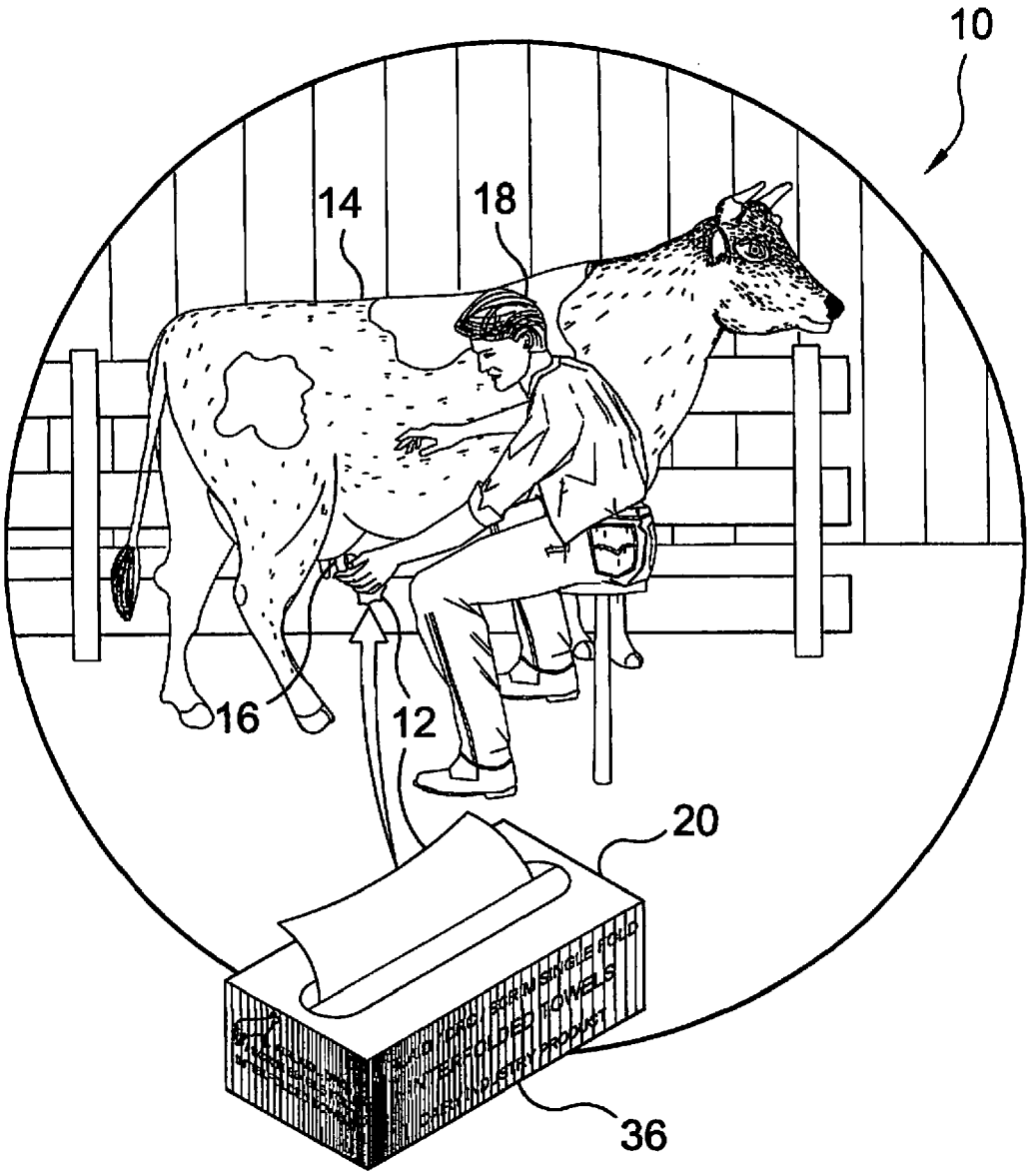
FIG. 6 is a perspective view of the present invention.

FIG. 6 is a perspective view of the present invention 10 in use. Shown is the user 18 wiping the teat 16 of a cow 14 with an Airlaid/DRC/Scrim single fold, interfolded towel 12. The present invention 10 provides an efficient methods of dispensing 20 said towels 12 such as the dispenser carton 36 shown in the illustration.

Figure 7:
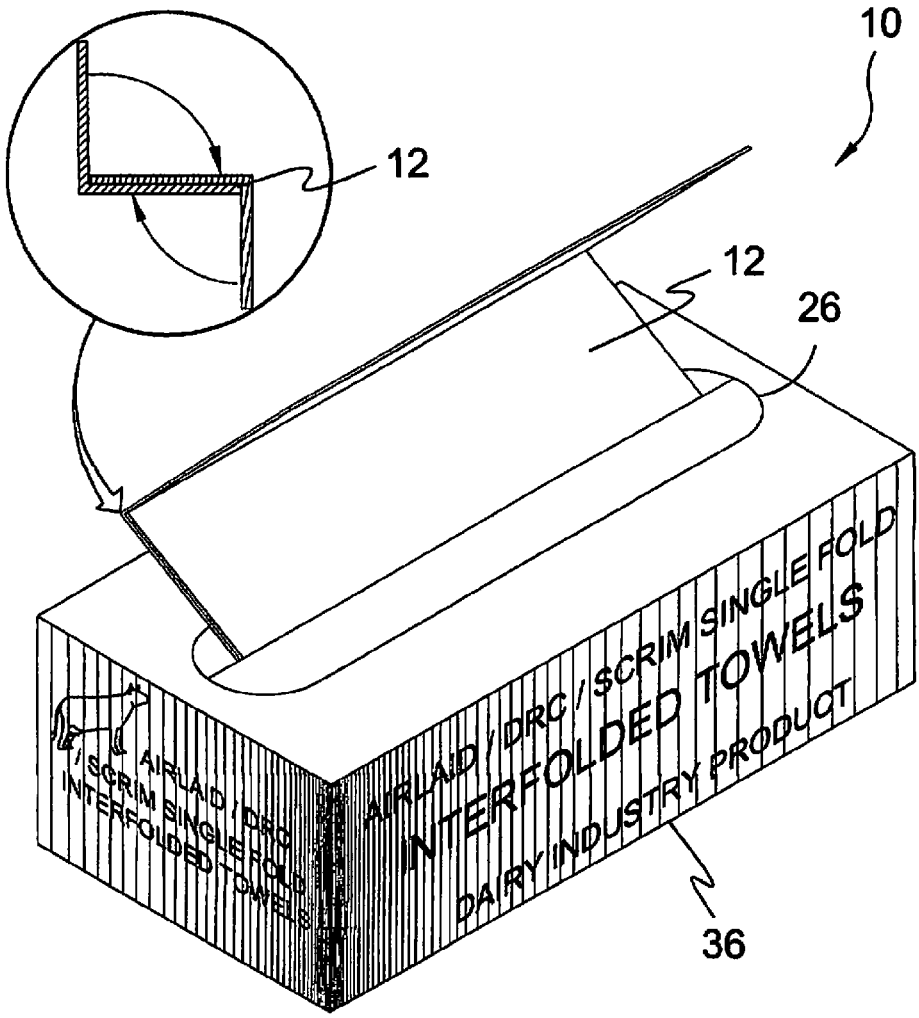
FIG. 7 is a perspective view of the present invention.

FIG. 7 is a perspective view of the dispenser carton 36 of the present invention 10. The dispenser carton 36 houses a plurality of Airlaid/DRC/Scrim single fold, interfolded towels 12. The single fold of the towels 12 serve to draw the following towel 12 through the dispenser slot 26 as it is removed by the user and also provides the user with a fully opened towel 12 to negate the necessity and wasted time of unfolding the towel to obtain the maximum surface area thereof.

Figure 8:
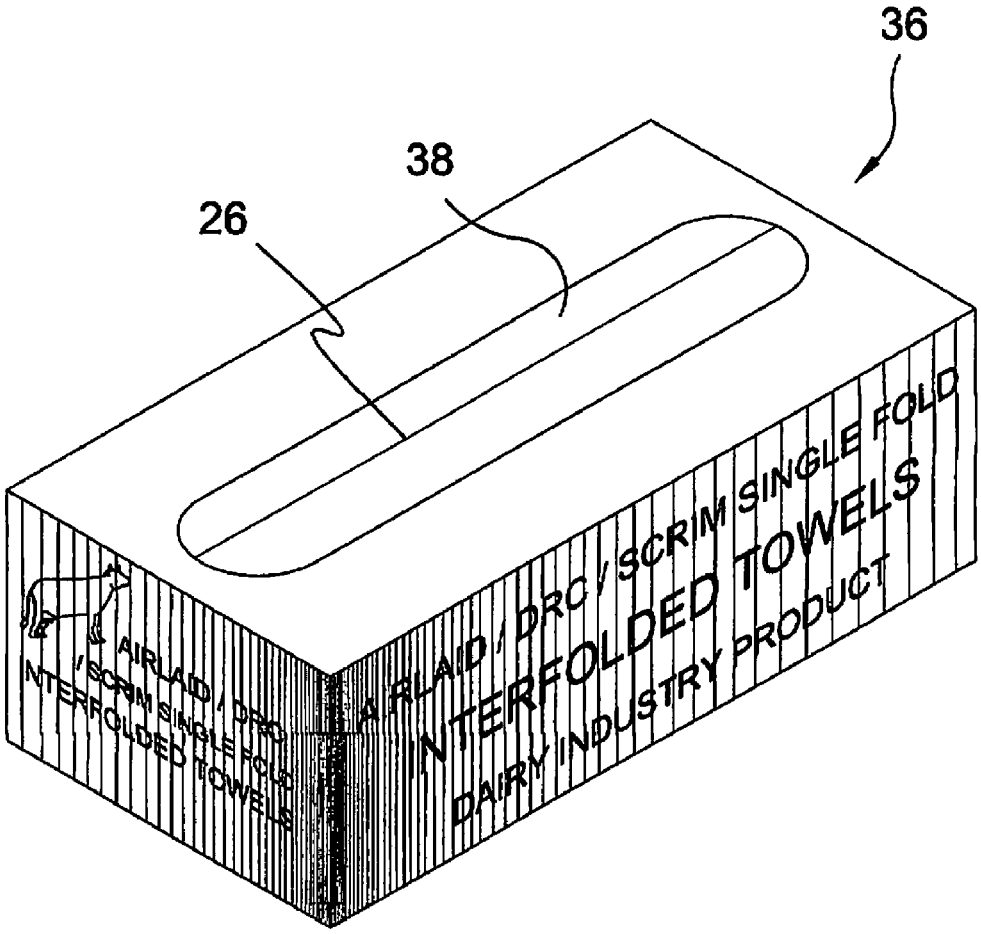
FIG. 8 is a perspective view of the present invention.

FIG. 8 is a perspective view of the dispenser carton 36. When not in use, the top Airlaid/DRC/Scrim single fold, interfolded towel is tucked into the carton 36 and protected from environmental contamination by a flexible protective seal 38 that provides a transition from the carton 36 to the dispensing slot 26. The seal 38 also protects towels contained therein during use.

Figure 9:
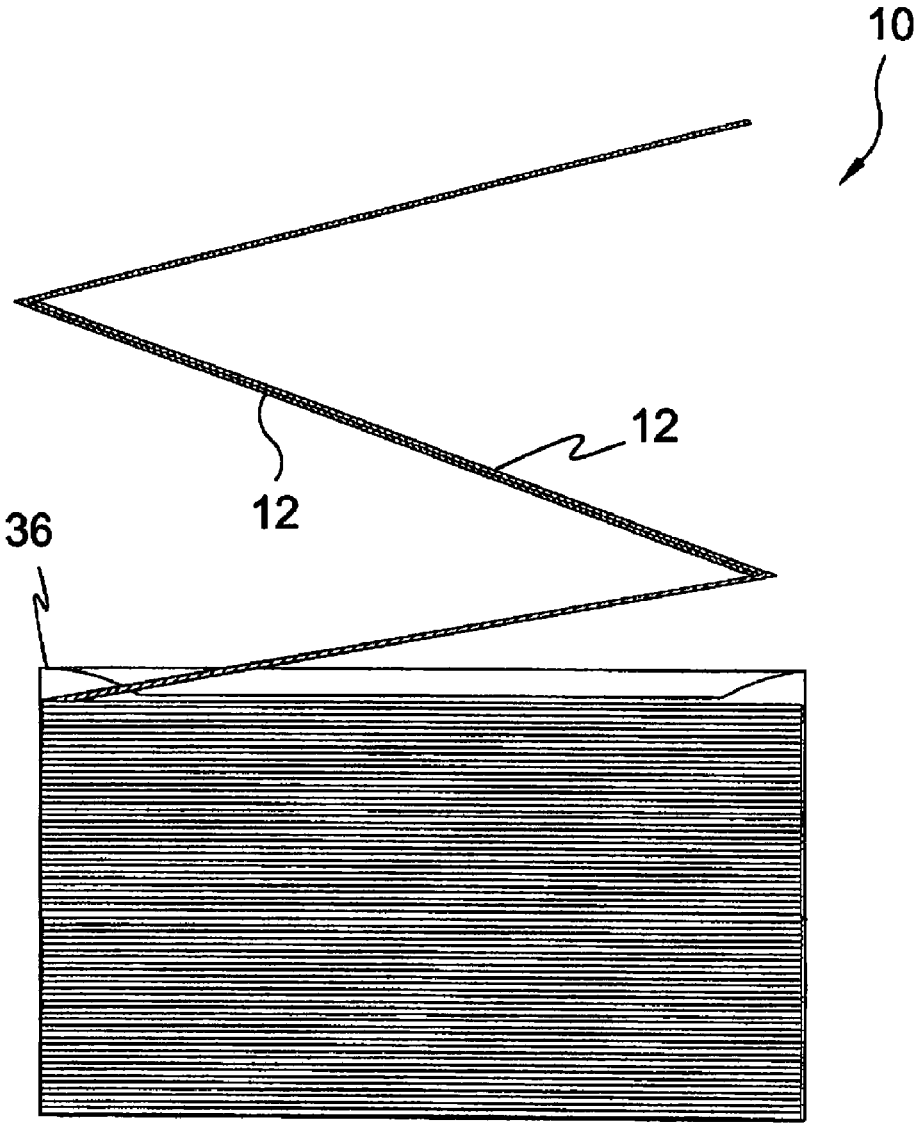
FIG. 9 is a side view of the present invention.

FIG. 9 is a side view of the present invention 10. The dispenser carton 36 houses a plurality of plurality of Airlaid/DRC/Scrim single fold, interfolded towels 12. The single fold of the towels 12 serve to draw the following towel 12 through the dispenser slot as it is removed by the user and also provides the user with a fully opened towel 12 to negate the necessity and wasted time of unfolding the towel to obtain the maximum surface area thereof.

Figure 10:
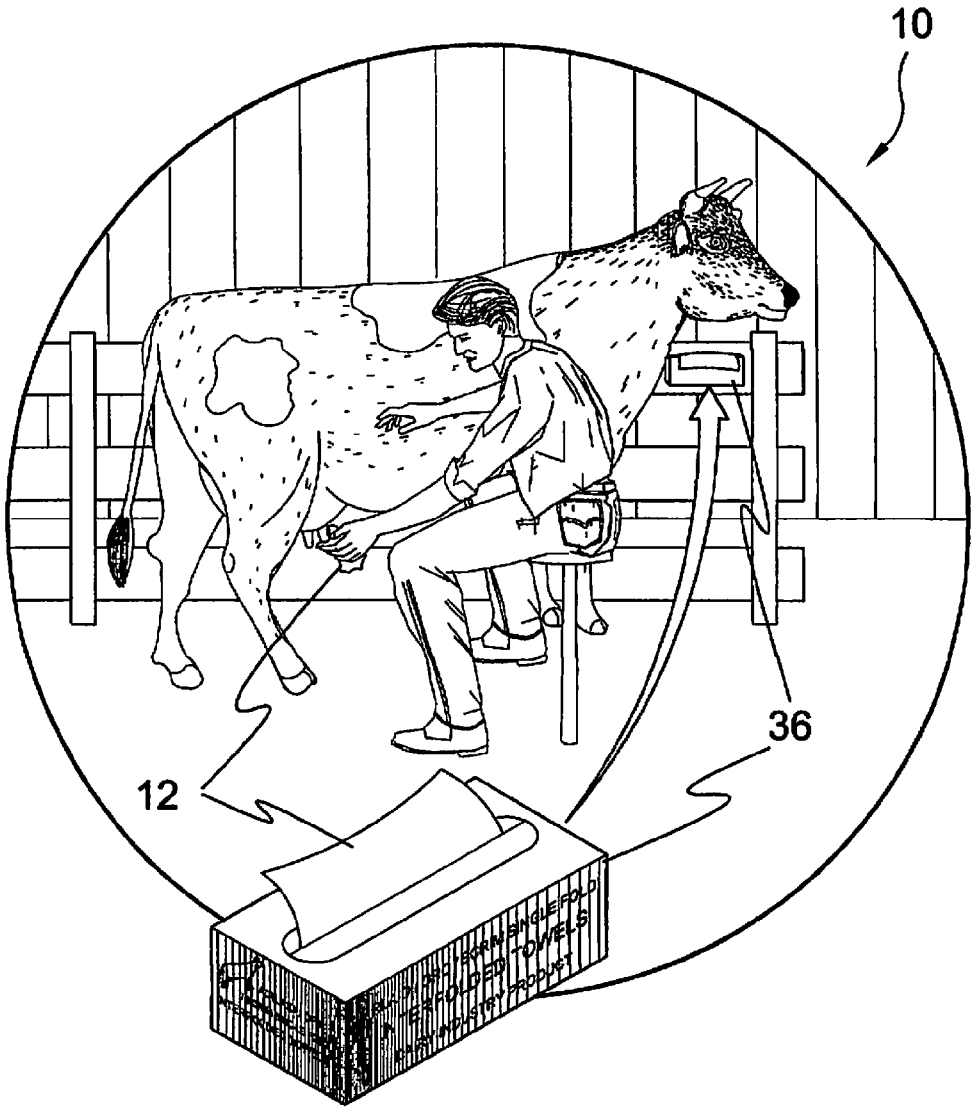
FIG. 10 is a perspective view of another method of dispensing the towel of the present invention.

FIG. 10 is a perspective view of another method of dispensing the towel 12 of the present invention 10. Shown is another method to dispense the towels 12 for the cleaning of cow teats. This method provides mounting capability to allow the user to mount the dispenser 36 in a convenient place.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention

The invention claimed is:

1. A refillable pouch in combination with a plurality of nonwoven single use towels for cleaning cow teats prior to milking to prevent the transmission of bovine mastitis therefrom and an improved means of distribution thereof consisting essentially of:

a single compartment, refillable pouch containing a vertically disposed stack of said towels wherein each towel has only a single fold line wherein a bottom portion of an uppermost towel extending from said fold line interleaves with a top portion of a subjacent towel so that each towel upon removal comes fully opened from said pouch providing a user with a fully opened towel of maximum surface area upon extraction without need for further manipulation thus optimizing the time and labor required to milk a large herd, and each towel having a basis weight of between 40 GSM and 80 GSM and two plys, said pouch having first, second, third and fourth sides, a closed bottom and an open top, said first side opposite said third side, said second side opposite said fourth side, said second and fourth sides joining said first and third sides, said second and fourth sides extending transverse with respect to said first and third sides;

said pouch having an integral, exposed outer flap covering said open top and a dispensing slot in said flap through which said towels are withdrawn when said flap covers said compartment, the towels in said pouch being vertically stacked beneath said slot with exposed edges of said towels aligned with said slot so that pulling a towel out through said slot positions a next towel in position to be withdrawn through said slot, said flap having a first portion covering said open top and a second portion extending down along an outside of said third side when said flap is in a closed position, a side flap extending from a side of said first portion of said flap, said side flap extending over said fourth side of said pouch when said flap is positioned over said open top, said side flap being spaced from said second portion of said flap when said side flap is over said fourth side and said second portion is over said third side, said first portion of said flap having a length extending between said first and said third sides, said side flap having a length extending between said first and said third sides, said length of said side flap being shorter than said length of said first portion, said first portion having a width extending between said fourth and said second sides, said second portion having a width extending between said fourth and said second sides, said width of said second portion being equal to said width of said first portion; and said pouch having a releasable strap adapted to be worn on a waist of the user to provide rapid access to said towels at all times during the process of milking a herd.

2. The nonwoven towels and means recited in claim 1, wherein extraction of a towel from said pouch leaves a portion of the subadjacent towel exposed to provide the user with rapid access to remaining towels when needed.

3. The nonwoven towels and means recited in claim 2, wherein said pouch is refillable through said opening when said flap is raised.

4. The towels and means recited in claim 3, wherein said cover flap has hook and loop fastening elements adjacent a free distal edge thereof for engagement with a side wall of said pouch for quick and easy engagement.

5. A fanny pack for dispensing single fold towels for cleaning cow teats prior to milking consisting essentially of:

a single compartment pouch having first, second, third and fourth sides, a closed bottom and an open top, said first side opposite said third side, said second side opposite said fourth side, said second and fourth sides joining said first and third sides, said second and fourth sides extending transverse with respect to said first and third sides;

an exposed outer flap having an edge attached to a top edge of said first side, said flap having a first portion covering said open top and a second portion extending down along an outside of said third side when said flap is in a closed position;

a vertically disposed stack of, single fold towels parallel with said bottom stacked within said compartment, said towels being of nonwoven material and having a basis weight of between 40 OSM and 80 OSM;

said first portion of said flap having a dispensing slot aligned with an exposed edge of a towel at a top of said stack and immediately below said slot, each towel in said stack interleaved with a towel directly beneath so that removal of a towel through said slot brings out a towel fully unfolded and ready for use, a side flap extending from a side of said first portion of said flap, said side flap extending over said fourth side of said pouch when said flap is positioned over said open top, said side flap being spaced from said second portion of said flap when said side flap is over said fourth side and said second portion is over said third side, said first portion of said flap having a length extending between said first and said third sides, said side flap having a length extending between said first and said third sides, said length of said side flap being shorter than said length of said first portion, said first portion having a width extending between said fourth and said second sides, said second portion having a width extending between said fourth and said second sides, said width of said second portion being equal to said width of said first portion;

the second portion of said flap having a first hook and loop fastener for engaging a mating hook and loop fastener on the outside of said third side to secure said flap when in its closed position;

straps connected to sides of said first side of said pouch for supporting said pouch on a waist of a user; and whereby said slot allows withdrawal of one towel at a time and opening of said flap allows for refilling of said pouch with clean towels.

* * * * *